US008882343B1

(12) United States Patent
Baldwin et al.

(10) Patent No.: US 8,882,343 B1
(45) Date of Patent: Nov. 11, 2014

(54) TIMER ASSEMBLY WITH LIGHTING FEATURES

(71) Applicant: Reliance Controls Corporation, Racine, WI (US)

(72) Inventors: Jeffrey P. Baldwin, Phoenix, AZ (US); John Klein, Gilbert, AZ (US); Ryan Liebengood, Gilbert, AZ (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 14/049,679

(22) Filed: Oct. 9, 2013

Related U.S. Application Data

(60) Provisional application No. 61/711,974, filed on Oct. 10, 2012.

(51) Int. Cl.
*G04B 47/00* (2006.01)
*G04B 19/30* (2006.01)

(52) U.S. Cl.
CPC ..... *G04B 19/30* (2013.01)
USPC ..... 368/313; 368/10

(58) Field of Classification Search
USPC ..... 368/9–12, 278, 309–313
See application file for complete search history.

(56) References Cited

U.S. PATENT DOCUMENTS

| | | | | |
|---|---|---|---|---|
| 2,688,366 | A | 9/1954 | Morrison | |
| 2,898,993 | A | 8/1959 | Huff | |
| 3,033,950 | A | 5/1962 | Flegel | |
| 4,311,886 | A | 1/1982 | Rulseh | |
| 4,379,639 | A * | 4/1983 | Stephens | 368/12 |
| 4,766,331 | A | 8/1988 | Flegel et al. | |
| 4,810,897 | A | 3/1989 | Shotey | |
| 4,822,964 | A | 4/1989 | Koch | |
| 4,835,520 | A * | 5/1989 | Aiello | 340/545.6 |
| 4,853,558 | A | 8/1989 | Skarivoda | |
| 5,138,590 | A * | 8/1992 | Masuda et al. | 368/10 |
| 5,266,841 | A | 11/1993 | Flegel | |
| 5,329,082 | A | 7/1994 | Saarem | |
| 5,747,760 | A | 5/1998 | Skarivoda | |
| D408,303 | S | 4/1999 | Janda et al. | |
| D409,505 | S | 5/1999 | Janda et al. | |
| D430,497 | S | 9/2000 | Michaels | |
| 6,816,438 | B1 * | 11/2004 | Zeller | 368/10 |
| D500,453 | S | 1/2005 | Cullen et al. | |
| 8,045,420 | B2 * | 10/2011 | Newman | 368/10 |
| 8,395,884 | B1 | 3/2013 | Czarnecki | |
| 8,415,573 | B2 | 4/2013 | Lipp et al. | |
| 2001/0036129 | A1 * | 11/2001 | Carr | 368/109 |
| 2002/0154574 | A1 * | 10/2002 | Ector et al. | 368/89 |

* cited by examiner

*Primary Examiner* — Sean Kayes
(74) *Attorney, Agent, or Firm* — Boyle Fredrickson, S.C.

(57) ABSTRACT

A timer is configured with a lighting feature so as to provide illumination to the timer in dark environments. The light may actuate by the interaction of an actuating member and sensor within the timer housing. The light may turn on when the enclosure door is in an open position and the light may turn off when the enclosure door is in a closed position. The timer assembly includes a base having a sensor, a lid having an actuating surface or member, a time indicator positioned in the base, and a light interconnected with the base, wherein the actuating surface or member selectively operates the light.

12 Claims, 3 Drawing Sheets

TIMER ASSEMBLY WITH LIGHTING FEATURES

CROSS-REFERENCE TO RELATED APPLICATIONS

This application claims priority to U.S. provisional application Ser. No. 61/711,974, filed Oct. 10, 2012, the entire contents of which is incorporated herein by reference.

BACKGROUND OF THE INVENTION

1. Technical Field

The present invention relates generally to a timer which may be used in commercial, industrial and residential applications, and more particularly, pertains to a timer with lighting features which actuate when the enclosure lid is in an open position to facilitate visibility in dark environments.

2. Background Art

Timers are used for a variety of applications and purposes throughout residential and commercial buildings. Timers provide automated and adjustable control of electrical devices without having to be physically present. Timers may be used to control pools, water heaters, lights, or any other suitable electrical component. The timers may be electrically controlled or mechanically controlled, with the mechanical variety having several trippers which operate to turn on and off the electrical component at the desired time. Since a timer is adjustable, the control mechanisms must be accessible from where the timer is mounted. The timer enclosures are generally mounted to a wall, post or other structure near the electrical object they are meant to control. The overall appearance and dimensions of timers vary greatly depending on the components utilized.

The present invention seeks to improve upon the prior art by providing a timer having a lighting feature to allow the user to more easily see the interior of the timer housing in dark environments.

SUMMARY OF THE INVENTION

The present invention is generally directed to a timer with a lighting feature. The light may actuate by the interaction of an actuating member and sensor within the timer housing. The light may turn on when the enclosure door is in an open position and the light may turn off when the enclosure door is in a closed position.

In one embodiment, a timer assembly includes a housing having a base having a sensor, a lid having an actuating surface or member such as an actuating pin, a time indicator positioned in the base, and a light interconnected with the base, wherein the actuating surface or member selectively operates the light.

In one aspect, the light may be turned on when the actuating surface or member disengages the sensor.

In another aspect, the sensor may extend forward from a back wall forming part of the base. The sensor may be positioned within a cavity formed by the base.

In another aspect, the light may be positioned within a cavity formed by the base.

In another aspect, the actuating surface or member may extend beyond a front surface of the lid.

In another aspect, the light may further include a shroud.

In another aspect, the shroud may deflect light downward.

In another aspect, the light may be turned off when the actuating surface or member engages the sensor.

In another aspect, the light may be in electrical communication with the time indicator.

In another aspect, the light may be a light emitting diode.

Various other features, objects and advantages of the present invention will be apparent from the following detailed description taken together with the drawings.

BRIEF DESCRIPTION OF THE DRAWINGS

The drawings illustrate the best mode presently contemplated for carrying out the invention.

In the drawings:

FIG. 3 is a side sectional view of the timer assembly of FIG. 1 taken along line 3-3 with the door in a partially open position, and showing the sensor disengaged and the light on.

DETAILED DESCRIPTION OF THE DRAWINGS

This invention relates to timer assemblies having a lighting feature so as to allow a use to more easily see the inner housing of the timer.

Figure 1:
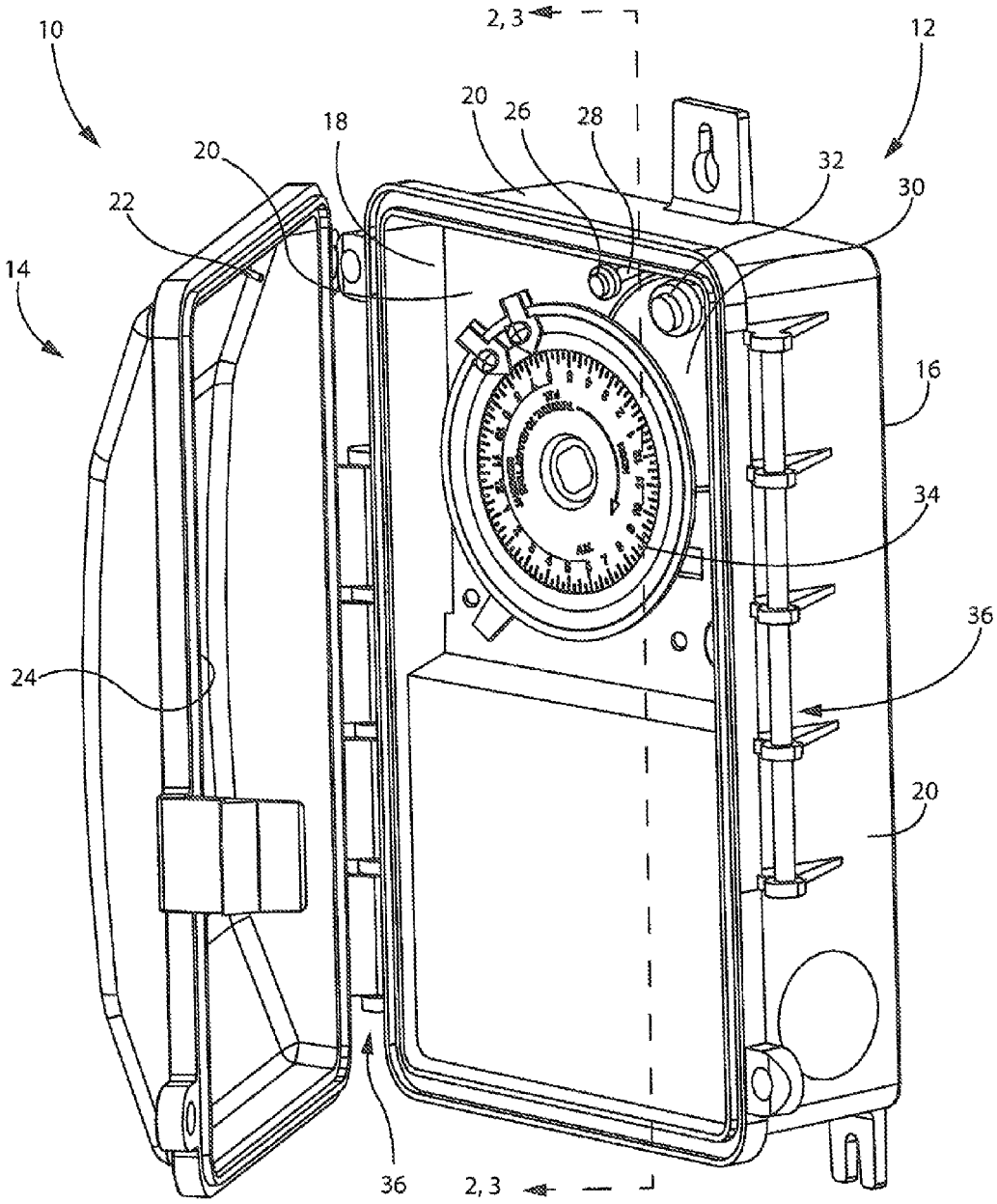
FIG. 1 is an isometric view of a timer assembly in accordance with the present invention showing a lighting feature installed therein.

FIG. 1 illustrates an isometric view of a timer assembly 10 having a base 12 and a cover or lid 14. The base 12 includes a back wall 16 and a front cavity 18 formed by the back wall 16 and the sidewalls 20 defining a rectangular enclosure. The lid 14 includes an actuating surface or member, which in the illustrated embodiment is an actuating pin 22 extending from a cavity 24 defined by the inner concave surface of lid 14, and which may be positioned wholly within the concave surface of cavity 24 or extend beyond the concave surface of cavity 24. While it is contemplated that timer assembly 10 is generally rectangular in shape, it is contemplated that timer assembly 10 may be defined by any desired size and shape.

The base 12 may include a sensor 26 extending from and spaced from the inner surface of back wall 16 by a rod 28. The sensor 26 may take the form of a switch which may be depressed when engaged and extended when disengaged and is generally biased toward the extended, disengaged state. The sensor 26 may be positioned within the cavity 18 such that the actuating pin 22 may engage the sensor 26 when the lid 14 is closed or when the lid. 14 is in a proximately close position to base 12. While it is contemplated that the sensor 26 and the actuating pin 22 are located within the interior of the timer assembly 10, it is also contemplated that the sensor 26 and the actuating pin 22 may be located outside of the timer assembly 10. They may be affixed to the exterior surface of the timer assembly 10 or extend from the exterior surface of the timer assembly 10.

A light 30 may be positioned in the cavity 18 and may be in the form of a light emitting diode or other suitable lighting device, such as a light bulb. A shroud 32 may be incorporated to deflect light away from the user's eye and specifically direct the light downwards so that an operator can see a time indicator 34 positioned within the front cavity 18 in dark or poorly lit places. The light 30 may be in electrical communication with the various components of the time indicator 34.

Figure 2:
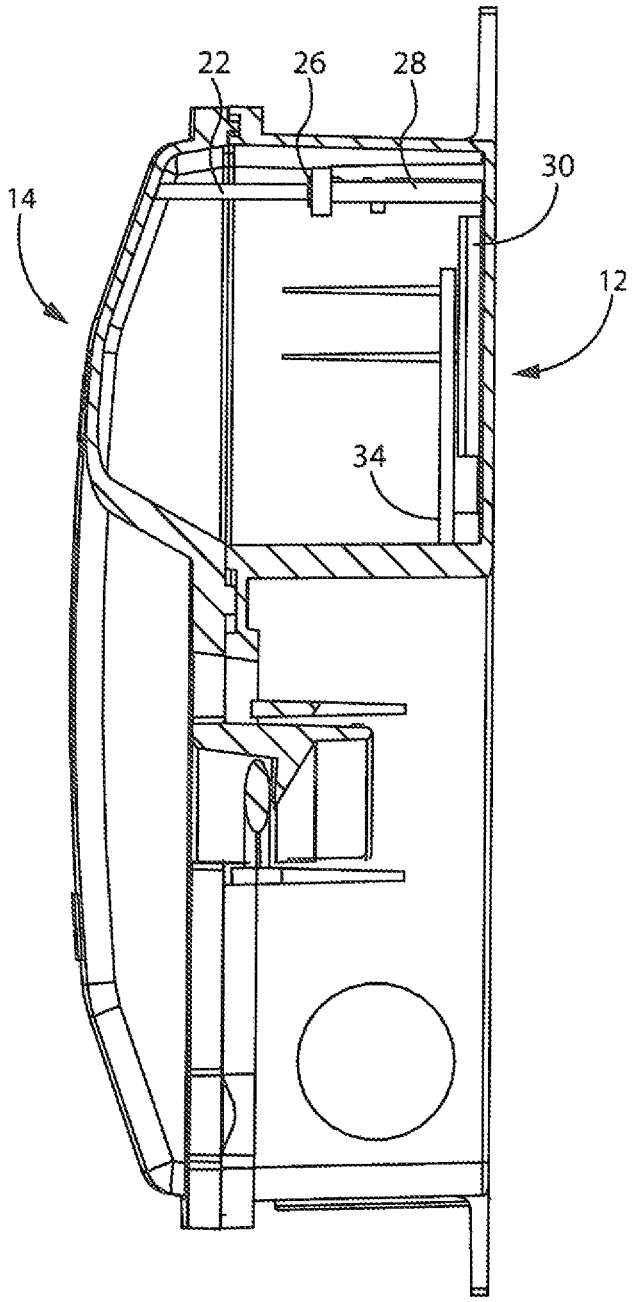
FIG. 2 is a side sectional view of the timer assembly of FIG. 1 taken along line 2-2 with the door in a closed position, and showing the sensor engaged and the light off.
Figure 3:
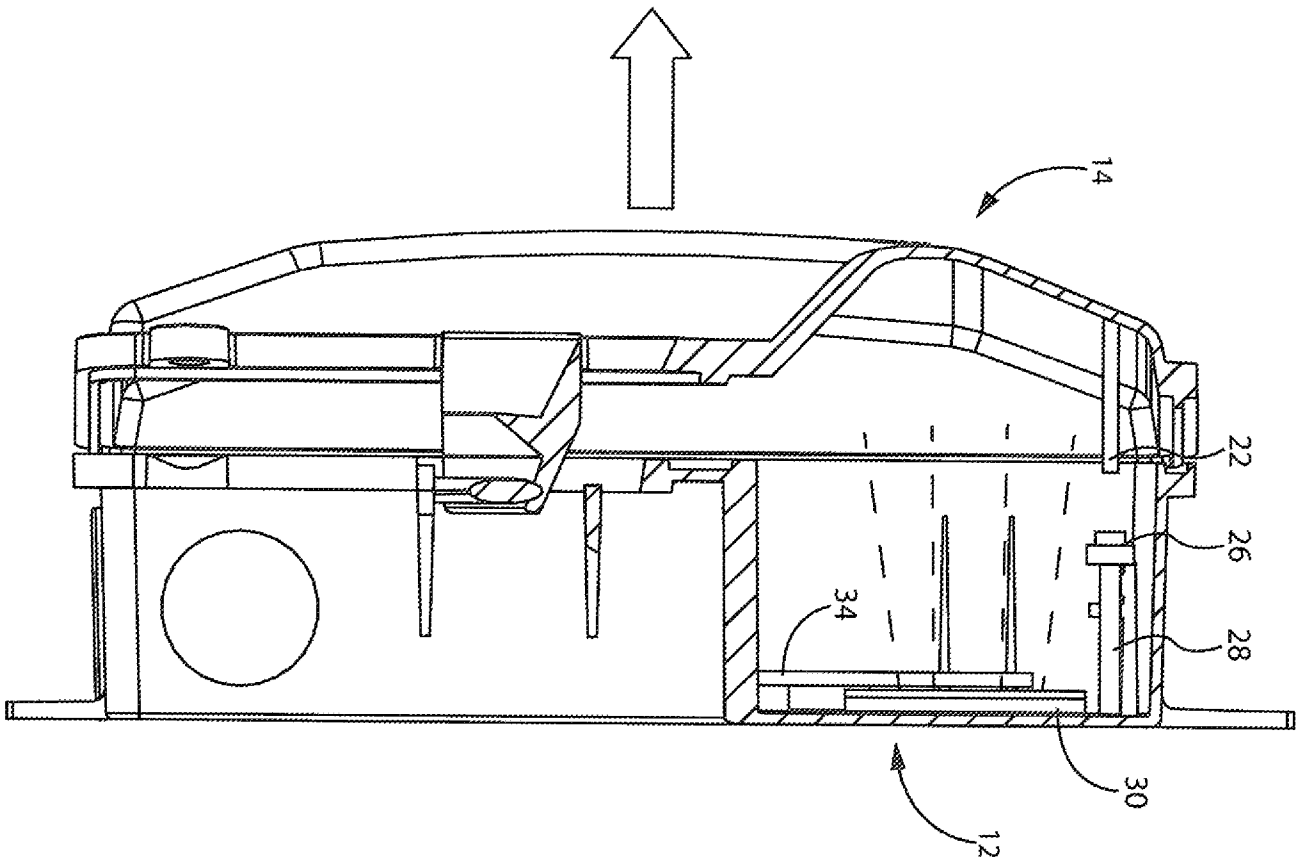

Referring to FIGS. 2-3, the timer assembly 10 provides selective illumination of the light 30 when the actuating pin 22 engages or disengages the sensor 26 as the lid 14 is pivoted open or closed from the base 12.

As seen in FIG. 2, when the lid 14 is pivoted to a closed position, the actuating pin 22 engages the sensor 26 so as to mechanically depress the sensor 26. Depression of the sensor 26 results in electrical deactivation such that the light 30 is in an off position.

As seen in FIG. 3, when the lid 14 is in an open or partially open position, the actuating pin 22 disengages with the sensor 26 such that the sensor 26 is mechanically extended, such as via a spring or the like in a manner as is known. Extension of the sensor 26 results in electrical activation such that the light 30 is turned on, and thus, emits light outward.

It is appreciated that the electrical activation of the light 30 via actuation of the sensor 26 is consistent with the electrical activation technology known in the art.

In another embodiment, a sensor may be located at hinges 36, which pivotably mount the lid 14 to the base 12 such that when the lid 14 is opened the light 30 is illuminated and when the lid 14 is closed the light 30 is off.

In still another embodiment, a photoelectric sensor (not shown) may be located on the timer assembly 10 such that the light 30 may not illuminate when the photoelectric sensor detects the presence of light. The photoelectric sensor may function independently from the sensor 26 or may override the sensor 26 in situations when the lid 14 is open but there is an external presence of light.

As an alternative embodiment, an actuator, such as the actuating pin 22 or other structure associated with the lid 14, may be configured to break a light path within a photosensor component to turn the light 30 on and off. In addition, a light such as 30 may be visible on the outside of the lid 14 and may be actuated by the timer to show an on/off condition, or the light may change color based on some predetermined conditions, for example, green for on, red for off, yellow for power loss, etc.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention

We claim:

1. A timer assembly comprising:

a housing comprising a lid, a base, and a hinge rotatably connecting the lid and the base, wherein the lid includes an actuating pin, and wherein the base comprises a timer, a timer indicator, a sensor and a light;

wherein the timer is configured to automatically control on and off times of at least one electrical component external to the housing;

wherein the lid is movable via the hinge relative to the base between an open position and a closed position, and wherein the sensor monitors the open and closed position of the lid and the actuating pin of the lid contacts the sensor of the base when the lid is in the closed position;

wherein the light is operated to be in an on condition when the lid is in the open position and in an off condition when the lid is in the closed position, and wherein the base and the light are configured to direct light onto the timer indicator when the lid is in the open position and the light is in the on condition.

2. The timer assembly of claim 1 wherein the light is turned on when the actuating pin disengages the sensor.

3. The timer assembly of claim 1 wherein the sensor extends forward from a back wall forming part of the base.

4. The timer assembly of claim 3 wherein the sensor is positioned within a cavity defined by the base.

5. The timer assembly of claim 1 wherein the light is positioned within a cavity defined by the base.

6. The timer assembly of claim 1 wherein the actuating pin extends beyond a front surface of the lid.

7. The timer assembly of claim 1 wherein the light further comprises a shroud.

8. The timer assembly of claim 7 wherein the shroud directs light onto the time indicator.

9. The timer assembly of claim 1 wherein the light is turned off when the actuating pin engages the sensor.

10. The timer assembly of claim 1 wherein the tight is in electrical communication with the time indicator.

11. The timer assembly of claim 1 wherein the light is a light emitting diode.

12. The timer assembly of claim 1, wherein the base comprises a shroud that blocks the light from a user's eyes and deflects the light downward toward the timer indicator.

* * * * *